United States Patent [19]

Kniel

[11] 4,041,721

[45] Aug. 16, 1977

[54] VESSEL HAVING NATURAL GAS LIQUEFACTION CAPABILITIES

[75] Inventor: Ludwig Kniel, Scarsdale, N.Y.

[73] Assignee: The Lummus Company, Bloomfield, N.J.

[21] Appl. No.: 593,223

[22] Filed: July 7, 1975

[51] Int. Cl.[2] ..... F17C 13/02

[52] U.S. Cl. ..... 62/45; 62/240; 114/74 A; 114/77 R

[58] Field of Search ..... 62/45, 55, 240, 298; 114/74 A, 77 R; 220/9 LG

[56] References Cited

U.S. PATENT DOCUMENTS

| | | | |
|---|---|---|---|
| 3,605,425 | 9/1971 | Cuneo et al. | 114/74 A X |
| 3,696,631 | 10/1972 | Valdes | 62/240 X |
| 3,722,230 | 3/1973 | Scott et al. | 62/240 X |

OTHER PUBLICATIONS

Kniel, L.: "Moving Natural Gas from the Arctic to Markets", June 24, 1974.

*Primary Examiner*—Ronald C. Capossela
*Attorney, Agent, or Firm*—Marn & Jangarathis

[57] ABSTRACT

There is disclosed a vessel having natural gas liquefaction capabilities formed of a plurality of self-contained liquefaction assemblies, each of which being disposed in a separate liquefaction compartment.

3 Claims, 2 Drawing Figures

FIG. 1
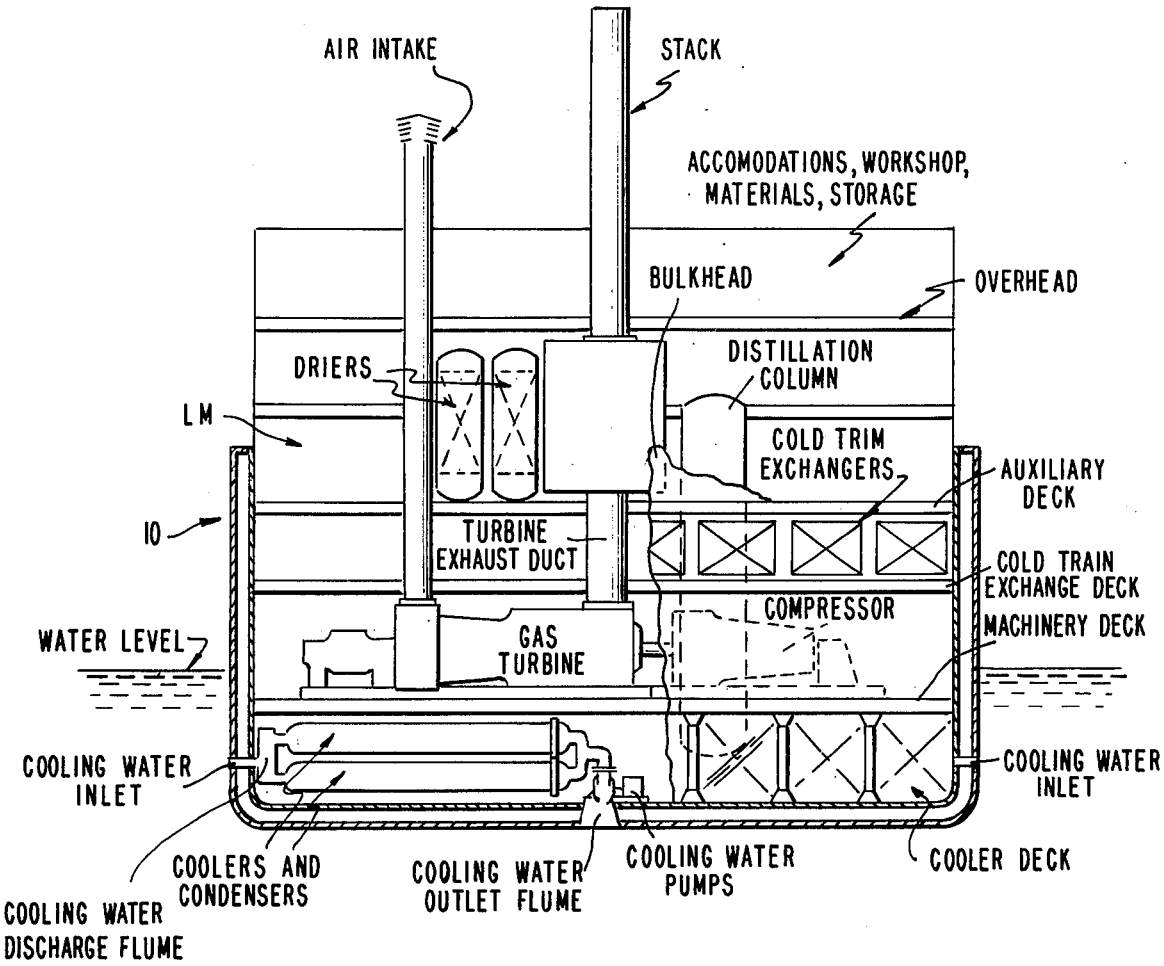
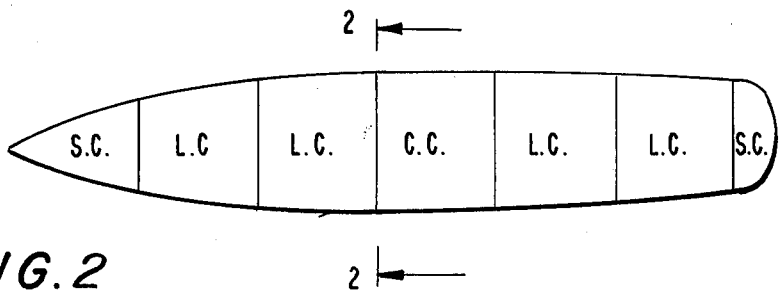
FIG. 2

VESSEL HAVING NATURAL GAS LIQUEFACTION CAPABILITIES

BACKGROUND OF THE INVENTION

This invention relates to an apparatus for the liquefaction of natural gas, and more particularly to the disposition of a plurality of such apparatus on a vessel.

In co-pendng application, Ser. No. 593,222 filed on July 1975 now U.S. Pat. No. 4,012,212 there is disclosed a process and apparatus for liquefying natural gas, which apparatus is disposed in modular form on a vessel to be located, inter alia, in the arctic islands north of the mainland of Canada. Such process and apparatus employ "cold gas techniques" to liquefy natural gas obtained in the dense phase. $C_5^+$ hydrocarbon fractions are separated after expansion of the dense phase natural gas which is re-compressed to the dense phase prior to the cooling thereof utilizing such cold gas techniques.

OBJECTS OF THE INVENTION

An object of my invention is to provide a vessel with natural gas liquefaction capabilities.

Another object of the present invention is to provide a vessel with natural gas liquefaction capabilities which is able to operate at latitudes where the construction and operation of a land base plant would be a substantial undertaking.

A further object of the present invention is to provide a vessel with natural gas liquefaction capabilities provided with the ultimate in simplicity and reliability.

Still another object of the present invention is to provide a vessel with natural gas liquefaction capabilities wherein equipment is disposed to aid in gyrostabilization of the vessel.

SUMMARY OF THE INVENTION

These and other objects of the present invention are achieved with a vessel compartmentalized to receive a plurality of liquefaction modules. The rotating masses for each module is disposed transverse to the axis of the vessel with any two compressor-driver assemblies having opposite senses of rotation.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein like numerals designate like parts throughout, and wherein:

FIG. 1 is a schematic view of the vessel illustrating compartmentalization thereof; and FIG. 2 is a sectional view of the vessel taken along the lines 2—2 of FIG. 1.

DETAILED DESCRIPTION OF THE DRAWINGS

Referring to FIG. 1, the vessel, generally indicated as 10, is compartmentalized in a manner to provide a control compartment (CC) centrally located with respect to the liquefaction compartments (LC) containing the liquefaction modules. The control compartment (CC) include, inter alia, support facilities and equipment, such as power generating units, feed water treating units, ventilation apparatus and the like. The remaining compartments include storage and the support facilities (SF). The liquefaction compartments (LC) are completely isolated by water and fire-proof bulkheads extending from the hull of the vessel to the top of each compartment including water and fire-proof overheads. Each compartment is ventilated by the facilities disposed in the control compartment (CC).

FIG. 2 illustrates a liquefaction module, generally indicated as (LM), having a capacity for example of about $2.5 \times 10^8$SCFD disposed in a liquefaction compartment (LC). The liquefaction module (LM), as disclosed in my aforementioned co-pending application includes an expander for expanding the dense phase natural gas to a pressure at which $C_5^+$ hydrocarbons ($C_5$ hydrocarbons and heavier) are available for separation in the liquid phase in a distillation column; a compressor for compressing the gaseous overhead from the distillation column to a pressure above the critical pressure thereof; and a cold gas system for providing the cooling requirements for the re-compressed natural gas. The cold gas system includes two casing cycle gas compressors—a low pressure casing driven by a gas turbine and a high pressure casing driven by a steam turbine with steam being provided from an unfired boiler utilizing the gas turbine exhaust heat. Each turbine is provided with an expander helper.

The compressor-driver assemblies constituting large rotating masses are disposed transverse to the axis of the vessel with adjacent compressor-driver assemblies having opposed senses of rotation. Cycle gas coolers and steam condensers are positioned at the lowest part of the vessel with rotative equipment on the deck above and cold train exchangers on the decks above that. The gas fractionator with trays of special design (perforated spirals as in air columns) is positioned in the middle of the vessel. The arrangement of the equipment is important to obtain a low center of gravity of the vessel and a low metacentric height in the interest of stability.

The coolers and condensers are positioned at the lowest part of the vessel and are in fluid communication with water inlet conduits disposed along the side of the hull of the vessel near the upstream portion thereof with respect to prevailing currents. The cooler and condenser outlets are in fluid communication with water outlet conduits positioned proximate to the keel of the vessel. In this respect, positioning of the water conduit inlets and outlets is important for warm water discharge through outlet conduits disposed in the side of the vessel would result, in arctic locations, in an ice fog which would enshroud the vessel whenever atmospheric conditions would be favorable, which would be most of the time. In more southerly locations, it would often give rise to fogs.

In the interest of safety, LNG storage capabilities on the vessel would be minimal. It is intended to transfer LNG onto a storage ship or barge for loading an LNG tanker, such as disclosed in U.S. Pat. No. 3,887,240, assigned to the same assignee as the present invention. In arctic locations, the storage ship would float in an open pool of water in the wake of the liquefaction ship.

As mentioned in the co-pending application, the vessel may or may not include propulsion units. It wll be readily appreciated that employing a plurality of liquefaction modules permits greater flexibility than one plant of combined capacity, since a problem requiring a shut down of a module would not require shut down of the remaining modules thereby only partially impairing capacity.

While a liquefaction compartment is discussed with reference to being separated by water and fire-proof bulkheads and overheads, it will be appreciated that each liquefaction compartment may be further compartmentalized in the interest of seaworthiness.

Numerous modifications and variations of the invention are possible in light of the above teachings and therefore the invention may be practiced otherwise than as particularly described.

I claim:

1. A vessel having natural gas liquefaction capabilities which comprises:

a hull divided by transversely disposed bulkhead means into a plurality of liquefaction compartments, said bulkheads being substantially water and fire-proof; and an integrated liquefaction assembly for liquefying natural gas disposed in each of said liquefaction compartments, said liquefaction assembly including compressors which are disposed transverse to the axis of said vessel with compressors of adjacent liquefaction assemblies having opposite senses of rotation.

2. The vessel as defined in claim 1 wherein said liquefaction assembly includes coolers and condensers, said coolers and condensers being in fluid communication with inlet conduits disposed in the side of said hull, said hull formed with a keel and having outlet conduits disposed proximate to said keel of said vessel.

3. The vessel as defined in claim 2 wherein said coolers and condensers are disposed in a lowest part of said hull.

* * * * *